United States Patent [19]

Vanstrom

[11] 4,196,692

[45] Apr. 8, 1980

[54] ADJUSTABLE PAINT GUARD FOR WINDOWS

[76] Inventor: Marc Q. Vanstrom, Rte. 1 P.O. Box 240, Post Falls, Id. 83854

[21] Appl. No.: 958,155

[22] Filed: Nov. 6, 1978

[51] Int. Cl.[2] ..... B05C 11/16

[52] U.S. Cl. ..... 118/504

[58] Field of Search ..... 118/504, 505; 15/246, 15/248; 51/262, 262.1, 265, 274, 310; 40/155; 160/221, 374

[56] References Cited

U.S. PATENT DOCUMENTS

| | | | |
|---|---|---|---|
| 253,520 | 2/1882 | DuBois | 160/374 |
| 1,593,183 | 7/1926 | Lindermayr | 160/221 |
| 1,605,670 | 11/1926 | Lee | 118/505 |
| 1,697,200 | 1/1929 | Morgana et al. | 118/505 |
| 1,757,587 | 5/1930 | Quinn | 40/155 |
| 2,164,299 | 6/1939 | Mandell et al. | 40/155 |
| 2,473,065 | 6/1949 | Miller | 49/395 |
| 2,484,607 | 10/1949 | Cherem | 118/504 |
| 2,632,971 | 3/1953 | Manczek et al. | 40/155 |
| 2,955,651 | 10/1960 | Replogle | 160/374 |
| 3,120,032 | 2/1964 | Burnette | 49/395 |

FOREIGN PATENT DOCUMENTS

| | | | |
|---|---|---|---|
| 48252 | 7/1909 | Switzerland | 40/155 |

*Primary Examiner*—Mary F. Kelley

[57] ABSTRACT

An adjustable, rectangular paint guard for masking glass window panes of varying dimensions, comprising four separate sections, each of which has two exterior, linear edges which meet to form one of the four corners of the paint guard, each section being in overlapping relationship to two of the other sections. Flexible molding extends from each linear surface, the bottom edge of the molding capable of abutting engagement with the inner margins of the pane. In the first embodiment, the sections are simultaneously adjusted to the desired positions for a square window pane and in the second embodiment, the sections are capable of individual adjustment so as to accomodate rectangular-shaped panes of different dimensions.

5 Claims, 6 Drawing Figures

ADJUSTABLE PAINT GUARD FOR WINDOWS

BACKGROUND OF THE INVENTION

This invention relates to an aid for painting windows and, more particularly, to an adjustable paint guard for masking a rectangular window pane.

When painting windows, it is difficult to keep paint from dripping or splattering onto the window panes. Prior art devices which have tried to overcome that problem include handheld paint guides which are positioned adjacent to the window trim to prevent the paint from landing on the window pane. However, those paint guards must be moved about the pane as different portions of the trim are painted. Paint guards which are utilized to cover or protect an entire pane are not adjustable to window panes of varying dimensions.

SUMMARY OF THE INVENTION

The above disadvantages are overcome by the present invention which comprises a paint guard which completely masks any sized rectangular window pane. The device includes four sections which are individually adjustable to form a rectangle of any desired dimension.

Each section has two linear, exterior surfaces which are perpendicular to each other and which meet to form a corner of the paint guard. The sections are in sliding, overlapping relationship with two adjacent sections. A flexible molding extends outwardly from each linear exterior surface and terminates in a downwardly sloping portion having a beveled bottom edge.

The first embodiment of the invention is utilized with square window panes and includes a flanged pin laterally projecting from the rear of each section which rides within an arcuate-shaped groove on the surface of a circular plate. The positions of the sections with respect to each other are simultaneously changed by the clockwise or counter-clockwise rotation of the circular plate, causing the sections to expand or contract in relation to each other.

A threaded screw projects outwardly from the center of the circular plate and extends through the center of the sections and thence through the center of a cover plate. A threaded knob is received on the end of the screw and is tightened to cause the edges of the cover plate to bear against the front of the sections and cause the circular plate to bear against the rear surfaces of the sections, thus clamping the sections in the desired position.

The second embodiment of the present invention allows for independent adjustment of the spatial relationship of the corners of the paint guard. Each section is pivotally connected to a small, rectangular plate by means of an arm which is pivotally connected to a corner of the plate and which is telescopically received within a sleeve that is pivotally mounted on the section. Any side of the guard can be extended or contracted by pulling outwardly or pushing inwardly the respective two sections which comprise that side. The plate includes an outwardly projecting screw which, as in the first embodiment, extends through the center of a cover plate and has a threaded knob thereon. The cover plate may be loosened to allow selected movement of the sections or tightened to secure the sections in their respective positions.

In both embodiments, the paint guard is adjusted to fit the corresponding window pane so that the bottom edges of the flexible molding abut the inner margins of the pane. Paint can then be applied to the sash and mullions around that pane without paint dripping or splattering onto the window pane itself. The guard can be readily applied to each pane of that window without having to re-adjust the sections.

DETAILED DESCRIPTION OF THE ILLUSTRATIVE EMBODIMENTS

A. First Embodiment

Figure 1:
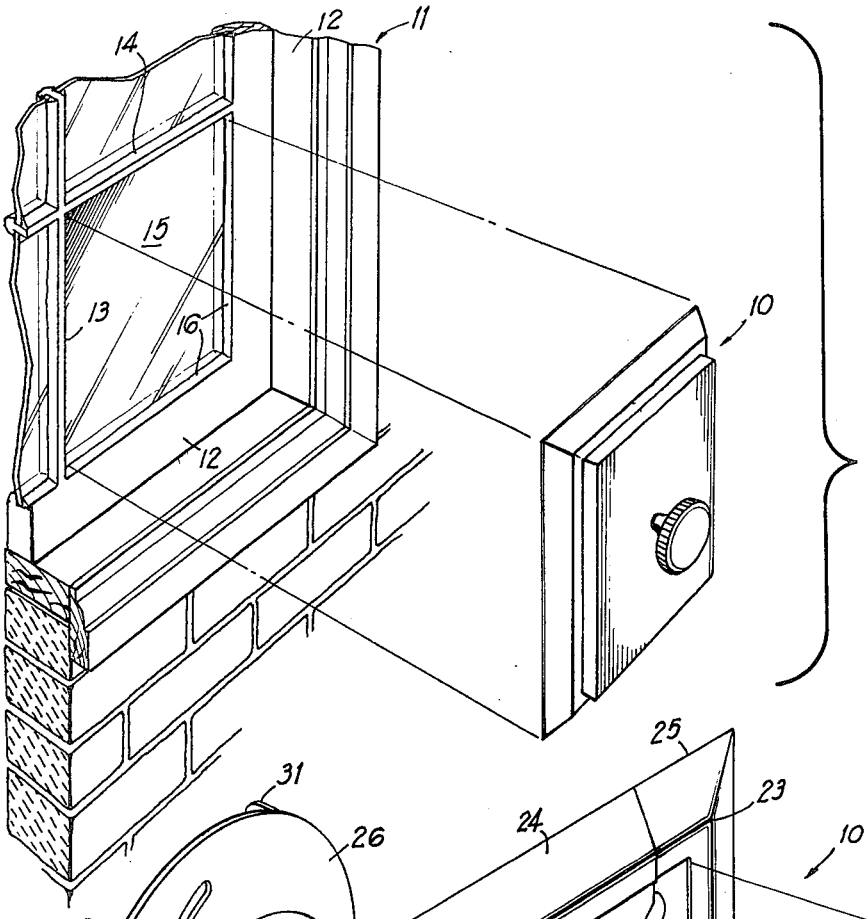
FIG. 1 is an exploded perspective view of either embodiment of the present invention in operation.

Referring now to the figures of the drawings, the numeral 10 denotes generally the device of the first embodiment of the present invention as shown in FIGS. 1, 2, 3 and 4. FIG. 1 illustrates both the first and second embodiment of the present invention for utilization on a conventional window frame 11 comprising sash 12, vertical and horizontal mullions 13,14 and rectangular window pane 15. The sash 12 and mullions 13,14 have inner margins 16.

Figure 2:
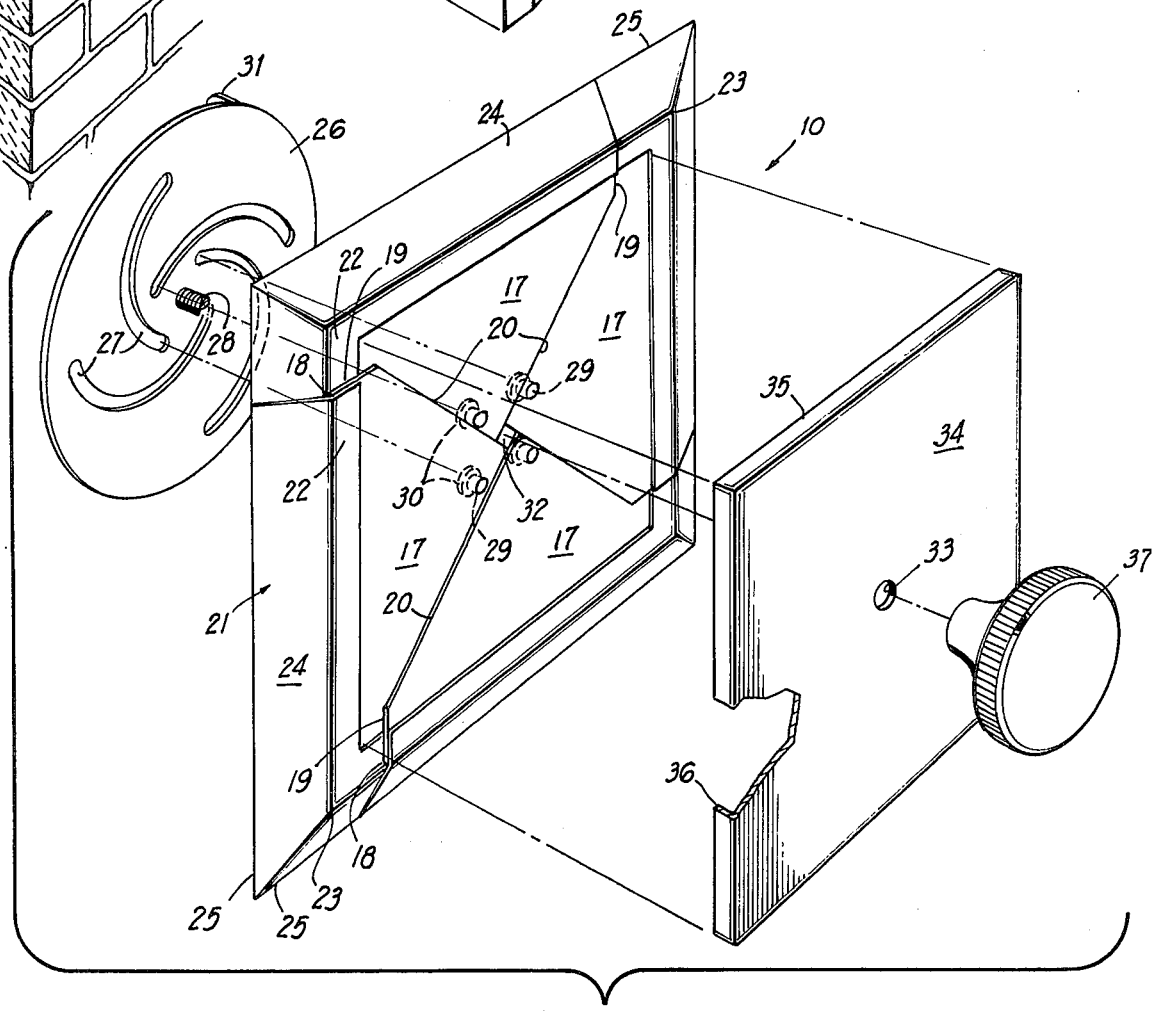
FIG. 2 is an exploded perspective view of the first embodiment.
Figure 3:
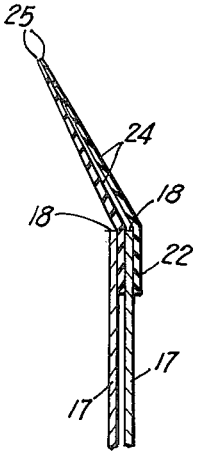
FIG. 3 is a fragmentary vertical side view of either embodiment.
Figure 4:
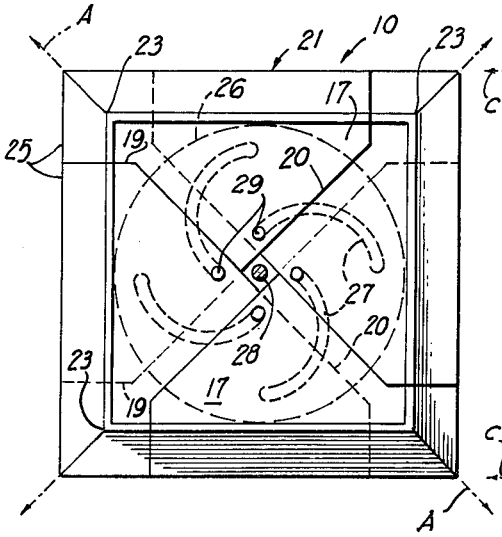
FIG. 4 is a front end view of the first embodiment with the cover plate and knob removed.

The device 10 is applied to square shaped window panes and includes four sections 17, each of which has two exterior, linear sides 18 which are perpendicular to each other and which meet for form a 90° corner. The sections 17 may be constructed of any suitable material, such as plastic. Each section 17 also includes interior sides 19 which are joined by slanting side 20. As seen in FIGS. 2–4, each section 17 is in overlapping relationship to two of the other sections 17.

Each section 17 is provided with a unitary, right-angled shaped piece of flexible molding 21 around the linear sides 18 and which, as more clearly shown in FIG. 3, includes portion 22 which is bonded along its underside to section 17 inwardly of sides 18. Each molding 21 includes a corner 23. The leading edge of portion 22 terminates in a downwardly extending, tapering portion 24 which has a bottom edge 25. The top surface of portion 22 is in sliding engagement with the underside of a respective section 17. The width of the respective portions 24 are such that each edge 25 is in alignment with the edge 25 of the overlapping molding 21 on the adjacent section 17, as shown in FIG. 3.

Means are provided on the first embodiment 10 for simultaneously changing the spatial relationship of the corners 23 inwardly or outwardly of each other, depending on the dimensions of the particular pane 15. Such adjustment will cause the distance between the corners 23 of the respective sections 17 to shorten or lengthen. As shown in FIG. 2, the adjusting means includes a rotatable element or circular plate 26 on the rear of the device 10, the plate 26 having four identical arcuately-shaped grooves 27 thereon which radiate in spaced arrangement from the centrally disposed threaded-screw 28 projecting upwardly from the plate 26. Projecting outwardly from the rear of each section 17 is a pin 29 having a flange 30 which is received within a respective groove 27 on plate 26. A finger tab 31 projects from the rear of plate 26.

FIGS. 2 and 4 show the paint guard sections 17 in their contracted position, the slanting sides 20 abutting a pin 29 of an adjacent section 17 to form an opening 32 which is in alignment with threaded screw 28 and with hole 33 in cover panel 34. The cover panel 34 is rectangular in shape and includes depending flat sides 35 which terminate in bearing edges 36. Knurled knob 37 has a longitudinally extending hole which is complimentarily threaded to receive therein screw 28. Cover plate 34 and knob 37 provide a means for securing the sections 17 in the desired positions, as described hereinbelow.

B. Operation of First Embodiment

First, the size of device 10 is determined so that it completely masks pane 15. By grasping finger tab 31 and rotating circular plate 26 clockwise or counterclockwise, the sections 17 are contracted or expanded simultaneously. As the plate 26 is turned, the flanges 30 ride within grooves 27, causing the respective change in dimension of device 10 which is so constructed to allow the sections 17 to slide under or over each other. As the sections 17 are manipulated, the bottom edges 25 of the molding 21 remain in alignment so as to provide a substantially unbroken surface along each exterior side of the device 10. Referring to FIG. 4, arrows A denote the direction of movement along which the sections 17 move as they are expanded or contracted, that movement being with respect to screw 28. The device 10 is adjusted so that the edges 25 are in abutting engagement with the inner margins 16 of sash 12 and mullions 13, 14.

When the desired shape of device 10 is obtained, the cover panel 34 is secured onto sections 17 by means of knob 37 engaging screw 28 and being tightened thereon. The edges 36 of cover plate 34 will then bear against the top surfaces of sections 17 and the circular plate 26 will bear against the rear of sections 17, the pressure from panel 34 and 26 clamping sections 17 in their desired positions. The edges 25 on the portions 24 of molding 21 extend below the circular plate 26 when the sections 17 are secured into position. As seen in FIG. 2, the dimension of cover panel 34 are such that edges 35 abut the rear edges of portions 22 when the device is in its most contracted position.

Once the sections are locked into position, the device 10 is applied to window 11 by the operator holding the knob 37 and firmly pressing the device against pane 15, so that no space is left between the inner margins 16 and the edges 25. Only edges 25 make contact with the surface of the window pane 15 to help prevent the paint from being drawn underneath device 10 by capillary action which might occur if there was more surface area of device 10 in contact with the pane 15. Paint can then be applied to the sash 12 and mullions 13, 14 without any of that paint coming in contact with window pane 15. Any excess paint will be received onto the flexible molding 21. After the sash 12 and mullions 13, 14 have been painted, the device 10 is removed from pane 15 and can be readily applied to another pane 15 of that window. When painting another window with panes different in size than pane 15, the device 10 can be adjusted so that the length of its sides, as evidenced by edges 25, can be decreased or increased, thereby decreasing or increasing the distance between corners 23.

C. Second Embodiment

Figure 5:
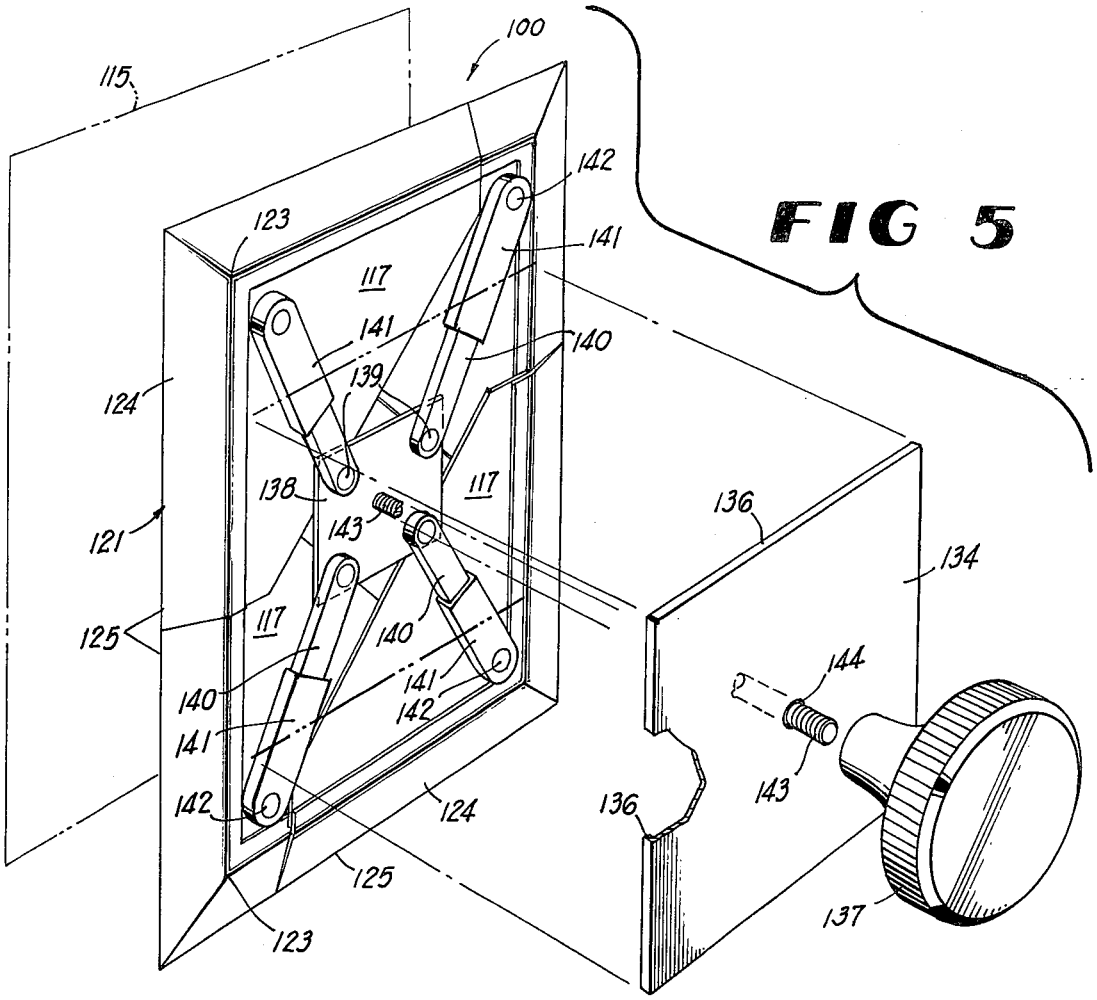
FIG. 5 is an exploded perspective view of the second embodiment of the present invention.
Figure 6:
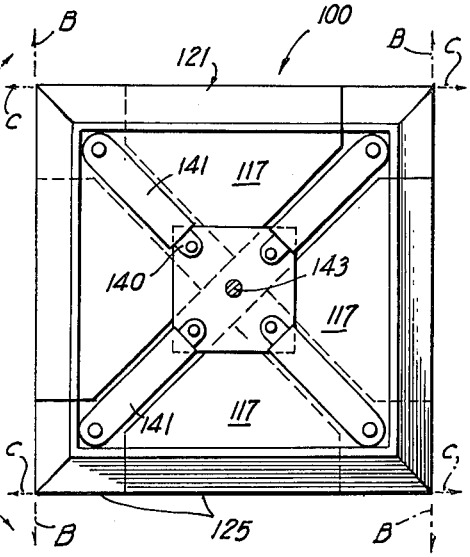
FIG. 6 is a front end view of the second embodiment with the cover plate and knob removed.

The device of the second embodiment is referred to generally by numeral 100 and is shown in FIGS. 5 and 6. FIGS. 1 and 3 also illustrate the operation of device 100.

Device 100 is utilized for all rectangularly shaped window panes 115, including square panes 15, and comprises sections 117, flexible molding 121, cover panel 134 and knob 137 which are similar in construction and function as the respective elements on device 10. The difference in the two devices 10, 100 is the means for securing the respective sections 17, 117 in their desired positions. The securing means for device 100 includes an overlying connecting member 138 in the shape of a small rectangular plate and having four upwardly projecting pins 139 positioned adjacent each of its corners. Pivotally mounted on each pin 139 about its end is an arm 140 which is slidably journaled within sleeve 141 that is pivoted about its end on pin 142 which projects upwardly from each section 117 adjacent each corner 123. Laterally extending from connecting members 138 is a threaded screw 143 which is received through hole 144 in panel 134 within a complimentary threaded opening within the bottom of handle 137.

FIG. 3 also illustrates the overlapping relationship of the sections 117 and portions 124.

D. Operation of the Second Embodiment

Unlike device 10, device 100 provides for independent adjustment of each section 117 along either direction shown by arrows B or C in FIG. 6. The knob 137 is loosened on screw 143 so as to relieve the pressure of bearing edges 136 on the device 100 and allow movement of sections 117.

Movement along the direction of arrow B is affected by grasping the portions 124 which form the top or bottom edges 125 of the device 100 at the point where the portions 124 overlap and pulling or pushing upwardly or downwardly until the desired separation of sections 117 is achieved. The arms 140 of the respective sections 117 will either be telescopically received within sleeves 141 or be extended therefrom, depending on the contraction or expansion of the sections 117. As the sections 117 are extended or contracted, the respective arms 140 and sleeves 141 will pivot about their respective pins 139, 142 to allow for the required movement. Of course, when the position of one section 117 is adjusted the section 117 with which the other section 117 forms a linear edge must correspondingly be adjusted so that the edges 125 are in alignment. It is understood that movement of sections 117 in the direction along arrow C is accomplished by pushing or pulling the two sections 117 which form the respective sides of device 100.

As shown in FIG. 5, the device 100 has its sections 117 extended to allow masking of pane 115. In FIG. 6, the sections 117 are shown in their contracted positions in order that edges 125 may engage the inner margins of the borders of a pane that is smaller dimensioned than pane 115.

When the sections 117 are adjusted as desired, the knob 137 is tightened on screw 143 to cause the bearing edges 136 to press against the sleeves 141 to secure the sections 117 in their desired positions. The device 100 may then be utilized to cover a window pane 115 as described above for device 10. The equal pressure simultaneously brought to bear on the four sleeves 141 by the bearing edges 136 prevents any movement of a sleeve 141 with respect to the other sleeves 141. In that manner, the arms 140 remain at their selected positions within each of the respective sleeves 141.

What I claim is:

1. A rectangular shaped paint guard for covering substantially an entire window pane having inner margins, comprising (a) four interleaved, flat sections, each of said sections having two exterior, linear sides which are perpendicular to each other and meet to form one corner of said guard, and wherein one of said linear sides forms a portion of a side of said paint guard with one of said linear sides of an adjacent one of said sections;

(b) means simultaneously changing the spatial relationship of each section with respect to the others of said sections so as to selectively lengthen or shorten the distance between one corner and an adjacent corner including a pin projecting outwardly from each of said sections, a rotable element, said rotable element having a groove dimensioned to receive therein said pin whereby rotation of said rotable element causes each of said pins to ride within each of said grooves;

(c) means for releasably securing said sections in a predetermined position; and (d) a flexible border downwardly extending at a bevel about the outer periphery of said linear sides of each of said sections, said downwardly extending borders terminating in bottom edges, said sections being capable of adjustment so that said bottom edges are in abutting engagement with said inner margins.

2. A paint guard as claimed in claim 1 wherein said securing means includes a screw having a threaded distal end centrally projecting outwardly from the surface of said rotable element, a cover plate for engagement with said guard on the side opposite from said rotable element, said plate having an opening therethrough dimensioned to receive said threaded distal end and a knob having an opening therein which is complimentarily threaded to receive said threaded distal end, whereby said threaded distal end extends through a passage formed among the rear of said sections, through said opening in said cover plate and into said knob, said cover plate and said rotable element being in opposed relationship so as to bear upon said sections when said knob is tightened.

3. A rectangular shaped paint guard for covering a window pane having innner margins, comprising:

(a) four overlapping flat sections, each of said sections having two exterior, linear sides which are perpendicular to each other and meet to form one corner of said guard, and wherein one of said linear sides forms a portion of a side of said paint guard with one of said linear sides of an adjacent one of said sections;

(b) means for changing the spatial relationship of each section with respect to the others of said sections so as to selectively lengthen or shorten the distance between one of said corners and an adjacent one of said corners including a connecting member in overlying relationship to said sections, four arms pivotally mounted on said connecting member for rotation about an axis which is perpendicular to said connecting member and a sleeve pivotally mounted on each of said sections for rotation about an axis which is perpendicular to said section, said sleeve being dimensioned to slidably receive therein one of said arms, whereby said sections may be independently moved within the same plane about said axes;

(c) means for releasably securing said sections in a predetermined position; and (d) a flexible border downwardly extending at a bevel from the outer periphery of said linear sides of each of said sections, said border terminating in a bottom edge, said sections being capable of adjustment so that the bottom edges of the borders are in abutting engagement with said inner margins.

4. A paint guard as claimed in claim 3 wherein said securing means includes a screw outwardly projecting from said connecting member, said screw having a threaded distal end, a cover plate, means on said plate for simultaneous bearing engagement with said sleeve, said cover plate having an opening dimensioned to receive therethrough said distal end of said screw so that said distal end projects above said cover plate and a knob capable of being threadedly received on said distal end so as to maintain said bearing means in engagement with each of said sleeves to prevent movement of said sleeves relative to each other by the tightening of said knob upon said distal end.

5. A paint guard as claimed in claim 4 wherein said cover plate is rectangular in shape and said bearing means includes sides depending about the outer perimeter of said plate, said sides terminating in bearing edges, said edges being in engagement with said sleeves.

* * * * *